United States Patent [19]

Wikstrom

[11] 4,173,802

[45] Nov. 13, 1979

[54] TOILET SEAT

[76] Inventor: Karl-Erik Wikstrom, Bergkullavagen 6, S-330 20 Anderstorp, Sweden

[21] Appl. No.: 887,315

[22] Filed: Mar. 16, 1978

[51] Int. Cl.[2] ..... A47K 13/12

[52] U.S. Cl. ..... 4/236; 4/240

[58] Field of Search ..... 4/236, 240, 234

[56] References Cited

U.S. PATENT DOCUMENTS

| | | | |
|---|---|---|---|
| 1,365,690 | 1/1921 | Heap | 4/236 |
| 2,333,732 | 11/1943 | Morris | 4/240 |
| 3,471,874 | 10/1969 | Dixon | 4/240 |
| 3,550,164 | 12/1970 | Pease | 4/236 |
| 3,613,129 | 10/1971 | Blount | 4/236 |
| 3,699,614 | 10/1972 | Stairs | 4/236 |
| 3,802,000 | 4/1974 | Waldon | 4/236 |
| 3,805,306 | 4/1974 | Stairs | 4/236 |
| 4,079,471 | 3/1978 | Corda | 4/240 |
| 4,087,884 | 5/1978 | Seiderman | 4/236 |

FOREIGN PATENT DOCUMENTS

| | | | |
|---|---|---|---|
| 25749 | 3/1930 | Australia | 4/236 |
| 939895 | 3/1956 | Fed. Rep. of Germany | 4/236 |
| 803817 | 10/1936 | France | 4/240 |
| 1200475 | 12/1959 | France | 4/236 |
| 348526 | 10/1960 | Switzerland | 4/236 |
| 507422 | 12/1938 | United Kingdom | 4/240 |
| 639684 | 7/1950 | United Kingdom | 4/240 |
| 917989 | 2/1963 | United Kingdom | 4/240 |
| 918560 | 2/1963 | United Kingdom | 4/240 |
| 922795 | 4/1963 | United Kingdom | 4/236 |
| 1239509 | 7/1971 | United Kingdom | 4/236 |
| 1248399 | 9/1971 | United Kingdom | 4/240 |

*Primary Examiner*—Henry K. Artis

*Attorney, Agent, or Firm*—Howson and Howson

[57] ABSTRACT

A hinge arrangement for detachably connecting a lavatory seat and cover to a lavatory stool employs a holder secured to the stool and a pair of hinge pins each having a pair of brackets secured thereto, one pair for attachment to the seat and one to the cover. The holder has two pairs of resilient C-shaped clips, each pair being such that one of the hinge pins can be pushed into and pulled out of it. The axial spacing between the clips of each pair equals the sum of the axial length of the bearing portion of the pair of brackets retained by that pair of clips, to provide axial positioning of the brackets.

1 Claim, 3 Drawing Figures

TOILET SEAT

The invention relates to hinge means for connecting a lavatory seat to a lavatory stool.

It is desirable for a lavatory seat to be connected to a lavatory stool in such a way as to ensure that the seat is simply accessible for cleaning purposes. A simple and adequate cleaning can usually be ensured only by removal of the seat from the lavatory stool. However, in hinge means of known construction, provided for connecting a lavatory seat to a lavatory stool, the whole assembly, including the hinge means, has to be removed from the lavatory stool, this being a difficult and time-consuming operation.

It is an object of the invention to provide hinge means for removably connecting a lavatory seat to a lavatory stool.

In accordance with the invention, this object is achieved by hinge means which comprise a holder adapted to be secured to the lavatory stool, and brackets secured to the seat, the brackets being detachably connected to the holder which is to be secured to the lavatory. In one preferred embodiment of the invention, the holder and the brackets are detachably interconnected by hinge pins and co-operable clips, the hinge pins being pressed into the clips in a direction transversely of the geometric axis of the pins, the clips deforming temporarily as a result of the elasticity of the material of the pins and/or of the clips.

The holder is conveniently provided with fixing elements for securing the holder to the lavatory stool, the fixing elements being adjustable to various positions in relation to the holder. It has thus become possible for a lavatory seat to be secured to lavatory stools of various constructions by means of the device according to the invention.

An embodiment of the invention is hereinafter described, by way of example, with reference to the accompanying drawings, in which.

Figure 1:
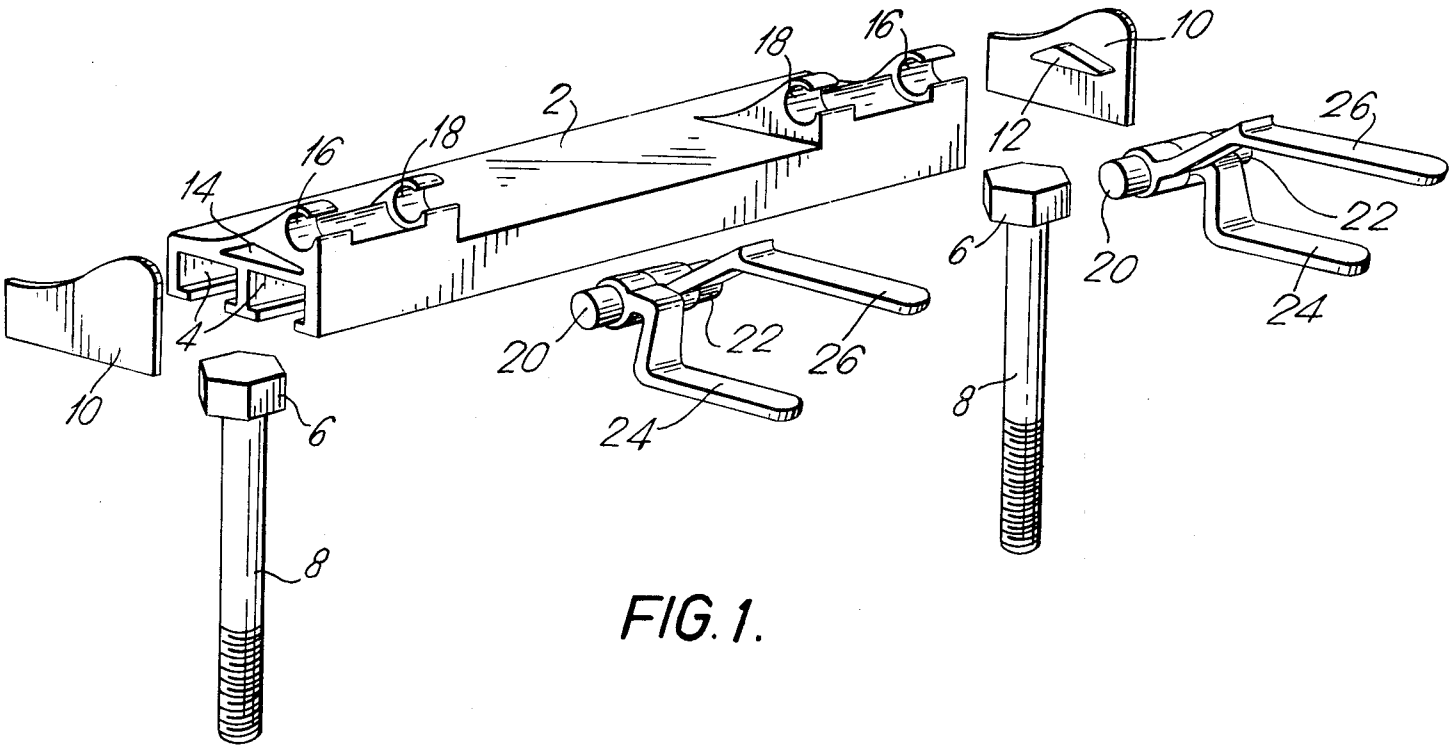
FIG. 1 is an exploded perspective view of hinge means according to the invention.
Figure 2:
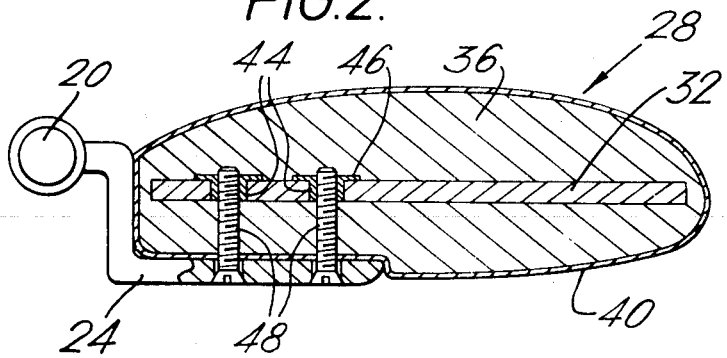
FIG. 2 is a sectional elevation part of the hinge means attached to a lavatory seat.
Figure 3:
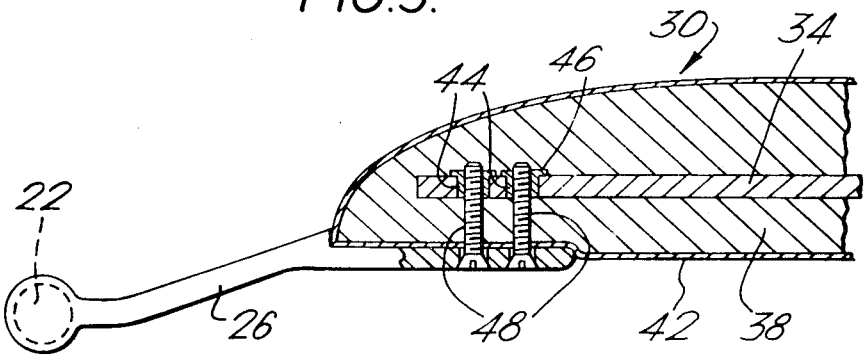
FIG. 3 is a sectional elevation of another part of the hinge means attached to a lavatory seat cover.

Referring to FIG. 1, hinge means according to the invention comprise a holder 2, made of a synthetic resin and having mainly the shape of an elongate plate. As shown in the left-hand end of the holder 2, grooves 4 are undercut into the underside of the holder 2. The grooves 4 are so arranged as to receive the heads 6 of bolts 8, the heads 6 of the bolts 8 being movable along the groove 4, longitudinally of the holder. The bolts 8 are arranged to extend through holes provided in a lavatory stool and to be held in position on the lavatory stool by means of nuts. The most convenient groove 4 may thus be selected for introduction of the head 6 of the bolt 8 in dependence upon the construction of the lavatory stool as far as the spacing and positions of the holes are concerned, and the position of the bolts 8 may be adjusted longitudinally of the holder, that is to say, the spacing of the bolts 8, may be adjusted as required. After the holder 2 has been secured to the lavatory stool, end-pieces 10 are fitted to the holder 2 to close the open ends of the grooves 4. The end-pieces 10 are formed with projections 12 which fit with press fit into recesses 14 provided in the holder 2. In addition, the holder 2 is provided with two pairs of hinge members 16 and 18 in the form of clips having C-shaped walls. Each pair of clips is adapted to receive the ends 20 and 22 of a hinge pin which project laterally from bearings which form carrying brackets 24 and 26. The brackets 24 and 26 on each hinge pin are respectively secured to a lavatory seat 28 and to a cover lid 30. The seat 28 and the cover 30 consist of internal boards or plates 32 and 34, made of a hard material such as wood-fiber board, which are respectively covered with thick layers 36 and 38 of a softer material and these layers are covered with external synthetic resin films or foils 40 and 42. The boards 32 and 34 are provided with holes containing inset screw nuts 44 with the aid of which the brackets 24 and 26 are secured to the seat 28 and to the cover 30. Plates 46 provided on the nuts 44 prevent the nuts from being pulled through the boards. The seat 28 and the cover 30 are attached to the brackets 24 and 26 by means of screws 48 which are screwed through the layers 36 and 38 of soft material and into the nuts 44 in the seat and in the cover. The lavatory seat 28 and the cover 30 are subsequently ready to be hinged to the holder 2 by pressing the ends 20 and 22 of the hinge pins into the clips 16 and 18, utilising the elasticity of the synthetic resin material of the holder 2. The brackets 24 and 26 are respectively secured to the seat 28 and to the cover 30 in such a way that the bearing portions of the brackets 24 and 26 are in axial abutment. Since the distance between adjacent clips 16 and 18 corresponds substantially to the axial width of the bearing portions of the bearings 24 and 26, the seat 28 and the cover 30 are fixed in the longitudinal direction of the holder 2 when the hinge pins are in position in the clips.

The assembly hereinbefore described holds the lavatory seat sufficiently securely in position on the lavatory while at the same time permitting simple removal of the lavatory seat for cleaning purposes.

Thus, without necessarily restricting the scope of the invention claimed, preferred embodiments of the invention may be summarised as follows:

1. Hinge means, for detachably connecting a lavatory seat and cover to a lavatory stool, characterised by a holder (2) which is adapted to be secured to the lavatory stool and by brackets (24 and 26) which are secured to the seat (28) and to the cover (30) and detachably connected to the holder (2).

2. Hinge means, according to Summary 1, characterised in that the holder (2) is provided with fixing elements (6 and 8) adapted to co-operate with fixing elements provided on the lavatory stool, and the fixing elements (6 and 8) of the holder (2) are adjustable to various positions in relation to the holder (2).

3. Hinge means, according to Summary 2, characterised in that the fixing elements (6 and 8) of the holder (2) are disposed in undercut grooves (4) formed in the underside of the holder (2) into which an enlarged portion of the fixing elements (6 and 8) may be inserted so as to be displaceable in the longitudinal direction of the grooves.

4. Hinge means, according to Summary 3, characterised in that the holder (2) is provided with parallel grooves (4) into which the fixing elements may be introduced.

5. Hinge means, according to Summary 3 or Summary 4, characterised in that the grooves (4) may be closed by covers (10) detachably fitted at the ends of the holder (2).

6. Hinge means, according to any preceding summary, characterised in that the holder (2) is provided with two pairs of resilient clips (16 and 18) to receive the opposite ends (20 and 22) of two hinge pins which pivotally support the brackets (24 and 26), the clips having resiliently deformable walls which define undercut slots so that the hinge pins may be introduced into and withdrawn from the clips.

7. Hinge means, according to any preceding summary, characterised in that the brackets (24 and 26) are respectively secured to the seat and to the cover by means of screws which engage in plates or boards of hard material provided in the seat and in the cover, the plate or board being lined with a soft material.

8. Hinge means, according to Summary 6 or Summary 7, characterised in that each bracket (24) secured to the seat (28) contacts one of the brackets (26) secured to the cover (30) and the opposite ends (20 and 22) of the two hinge pins are respectively received in the clips (16 and 18).

What we claim is:

1. Hinge means for detachably connecting a lavatory seat and cover to a lavatory stool, comprising:

a holder adapted to be attached to said stool; and a pair of hinge pins each having two brackets mounted thereon, one adapted for attachment to a lavatory seat and the other adapted for attachment to a lavatory cover, said holder comprising two pairs of resiliently deformable recessed clips, each pair of clips being adapted detachably to receive one of said pins by pressing said one pin into said each pair of clips in a direction transverse to the hinge pin axis, and adapted to permit removal of said one pin from said each pair of clips by urging it outwardly of said each pair of clips in the opposite direction;

each of said clips having C-shaped walls with their openings facing in the same direction and each of said brackets having a bearing portion exceeding said pins in diameter;

the axial spacing between the clips of each pair being substantially equal to the sum of the axial lengths of said bearing portions of the brackets retained by said pair of clips.

* * * * *